US008568200B2

(12) United States Patent
Liao

(10) Patent No.: US 8,568,200 B2
(45) Date of Patent: Oct. 29, 2013

(54) ULTRA-LOW TEMPERATURE MAGNETIC POLISHING MACHINE

(75) Inventor: Lu-Jung Liao, Taichung (TW)

(73) Assignee: Holding Electric Co., Ltd., Taichung (TW)

( * ) Notice: Subject to any disclaimer, the term of this patent is extended or adjusted under 35 U.S.C. 154(b) by 422 days.

(21) Appl. No.: 12/983,945

(22) Filed: Jan. 4, 2011

(65) Prior Publication Data

US 2012/0083190 A1 Apr. 5, 2012

(30) Foreign Application Priority Data

Oct. 4, 2010 (TW) ..... 99219150 U

(51) Int. Cl.
*B24B 49/14* (2006.01)

(52) U.S. Cl.
USPC ..... 451/7; 451/104; 451/327

(58) Field of Classification Search
USPC ..... 451/7, 104, 326, 327
See application file for complete search history.

(56) References Cited

U.S. PATENT DOCUMENTS

| | | | | | |
|---|---|---|---|---|---|
| 2,571,328 | A * | 10/1951 | Baker | 451/33 |
| 3,324,605 | A * | 6/1967 | Lester | 451/33 |
| 3,589,080 | A * | 6/1971 | Abbey | 451/33 |
| 5,044,128 | A * | 9/1991 | Nakano | 451/32 |
| 5,419,735 | A * | 5/1995 | Imahashi et al. | 451/113 |
| 5,611,725 | A * | 3/1997 | Imahashi | 451/104 |
| 5,662,516 | A * | 9/1997 | You | 451/113 |
| 6,227,942 | B1 * | 5/2001 | Hoffman | 451/36 |
| 2007/0207710 | A1 * | 9/2007 | Montierth et al. | 451/56 |

* cited by examiner

*Primary Examiner* — Maurina Rachuba
(74) *Attorney, Agent, or Firm* — Bacon & Thomas, PLLC

(57) ABSTRACT

An ultra-low temperature magnetic polishing machine includes a housing defining therein a grinding chamber, a door hinged to the housing and controllable to open/close the grinding chamber, a motor mounted inside the housing below the grinding chamber, a magnetic disc set in between the grinding chamber and the motor and rotatable by the motor to cause an alternative magnetic field in the grinding chamber, a freezer having an output pipeline inserted into the grinding chamber and freezing medium deliverable through the output pipeline into the grinding chamber, a container set in the grinding chamber, and magnetically conductive grinding media put in the container.

9 Claims, 6 Drawing Sheets

ULTRA-LOW TEMPERATURE MAGNETIC POLISHING MACHINE

BACKGROUND OF THE INVENTION

1. Field of the Invention

The present invention relates to magnetic grinding technology and more particularly, to an ultra-low temperature magnetic polishing machine, which uses magnetically conductive grinding media to impact the workpiece and to further remove burrs from the workpiece and polish the workpiece after lowering the temperature of the workpiece.

2. Description of the Related Art

Regular grinding devices commonly use grinding media, such as aluminum oxide balls, glass balls or plastic balls to impact the workpiece, achieving the desired polishing effect. During impact between the grinding media and the workpiece, particles will be produced to pollute the surroundings. To avoid this problem, magnetic polishing machines are developed. A conventional magnetic polishing machine is known comprising a workpiece chamber and magnetically conductive stainless steel needles. During operation, the magnetically conductive stainless steel needles and the workpiece are put in the workpiece chamber, and then a motor is started up to rotate a magnetic disc that carries multiple permanent magnets. During rotation of the magnetic disc, an alternative magnetic field is induced, causing movement of the magnetically conductive stainless steel needles in the workpiece chamber, and therefore the magnetically conductive stainless steel needles are forced to impact the workpiece, thereby removing burrs from the workpiece and polishing the workpiece. The magnetically conductive stainless steel needles have different mechanical properties when compared to aluminum oxide balls or plastic balls. Therefore, a less amount of particles will be produced when polishing the workpiece.

However, the aforesaid method of using magnetically conductive stainless steel needles to impact the workpiece for removing burrs from the workpiece and polishing the workpiece is not applicable for the processing of flexible materials. When polishing a flexible workpiece, such as rubber, plastics or silicon rubber, the flexible workpiece will be elastically deformed when impacted by the magnetically conductive stainless steel needles, losing the effects of polishing.

SUMMARY OF THE INVENTION

The present invention has been accomplished under the circumstances in view. It is the main object of the present invention to provide an ultra-low temperature magnetic polishing machine, which is practical for grinding a flexible workpiece.

To achieve this and other objects of the present invention, an ultra-low temperature magnetic polishing machine comprises a housing defining therein a grinding chamber, a door hinged to the housing and controllable to open/close the grinding chamber, a motor mounted inside the housing below the grinding chamber, a magnetic disc having an N pole and a S pole set in between the grinding chamber and the motor and rotatable by the motor to cause an alternative magnetic field in the grinding chamber, a freezer having an output pipeline inserted into the grinding chamber and freezing medium deliverable through the output pipeline into the grinding chamber, a container set in the grinding chamber, and magnetically conductive grinding media put in the container.

During operation, the freezer is operated to lower the temperature of the workpiece, and then start up the motor to rotate the magnetic disc when the workpiece become brittle, forcing the magnetically conductive grinding media to impact the workpiece and to further remove burrs from the workpiece and polish the workpiece.

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
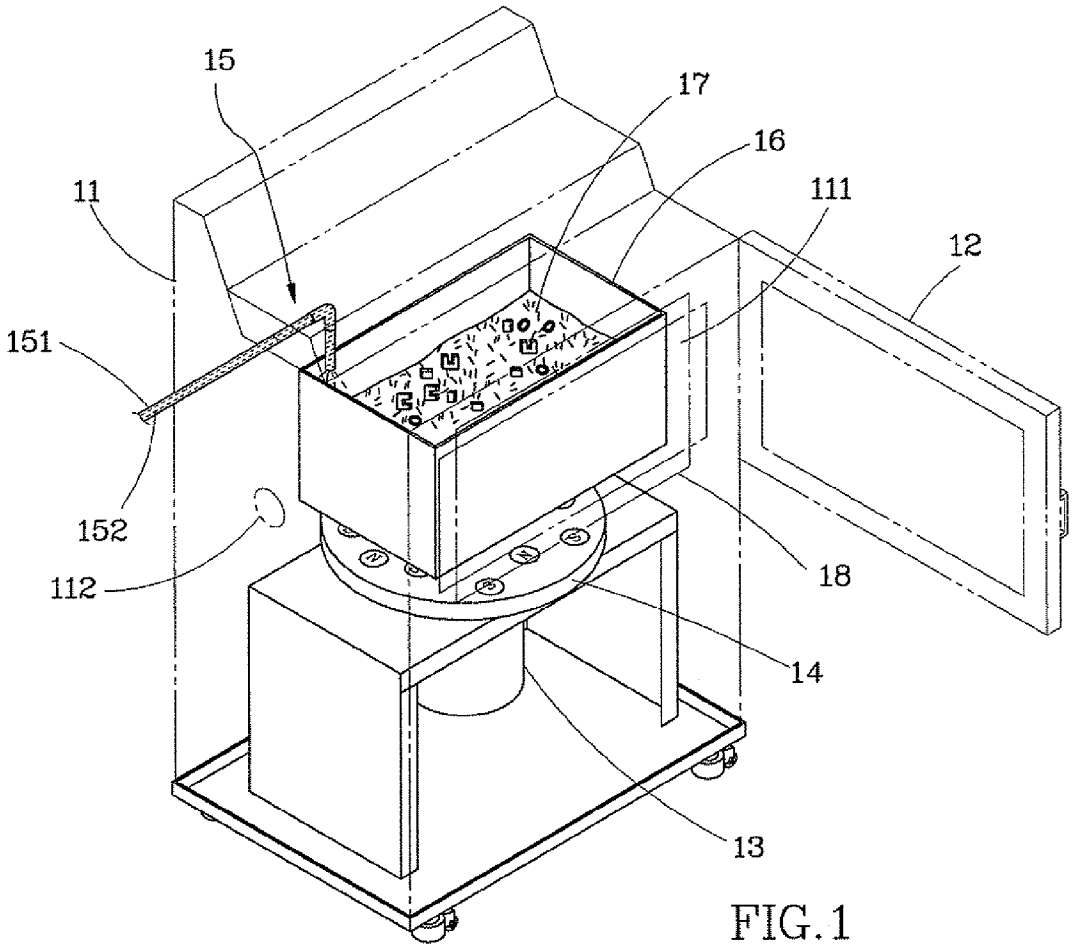
FIG. 1 is a perspective view of an ultra-low temperature magnetic polishing machine in accordance with a first embodiment of the present invention.

Referring to FIG. 1, an ultra-low temperature magnetic polishing machine in accordance with a first embodiment of the present invention is shown comprising a housing 11, a door 12, a motor 13, a magnetic disc 14, a freezer 15, a container 16 and a plurality of magnetically conductive grinding media 17.

The housing 11 defines therein a grinding chamber 111. Further, a thermal insulation material 18 is mounted inside the housing 11 around the grinding chamber 111 to decrease rates of heat transfer between the grinding chamber 111 and the outside space. It is to be understood that the thermal insulation material 18 is not essential. Therefore, the thermal insulation material 18 may be eliminated.

The door 12 is hinged to the housing 11, and controllable to open or close the grinding chamber 111.

The motor 13 is mounted inside the housing 11 below the grinding chamber 111.

The magnetic disc 14 is set in between the grinding chamber 111 and the motor 13 and rotatable by the motor 13. The magnetic disc 14 has an N pole and an S pole. During rotation of the magnetic disc 14, the N pole and the S pole causes an alternative magnetic field in the grinding chamber 111.

The freezer 15 comprises an output pipeline 151 and a freezing medium 152. The output pipeline 151 is inserted into the grinding chamber 111. The freezing medium 152 is delivered through the output pipeline 151 into the grinding chamber 111. The freezing medium 152 can be, for example, liquid nitrogen or liquid carbon dioxide. By means of delivering the freezing medium 152 into the grinding chamber 111 to absorb heat energy, the freezing medium 152 is changed into gas, rapidly lowering the temperature in the grinding chamber 111. Further, when the freezing medium 152 is changed into gas in the grinding chamber 111, the air pressure inside the grinding chamber 111 is relatively increased. Thus, the housing 11 has an exhaust port 112 located on its one lateral side in communication with the grinding chamber 111. Thus, when the freezing medium 152 is changed into gas in the grinding chamber 111, it will flows out of the grinding chamber 111 through the exhaust port 112 to the outside.

The container 16 is set in the grinding chamber 111. The container 16 according to this embodiment, the container 16 is a rectangular box. However, this is not a limitation. Alternatively, the container 16 can be a barrel. The magnetically conductive grinding media 17 are put in the container 16. According to this embodiment, the magnetically conductive grinding media 17 are stainless steel needles.

The operation of the first embodiment will now be explained hereinafter. After the user put the workpiece and the magnetically conductive grinding media 17 in the container 16, the container 16 is put in the grinding chamber 111, and then the door 12 is closed to seal the grinding chamber 111. Thereafter, operate the freezer 15 to deliver the freezing medium 152 through the output pipeline 151 into the grinding chamber 111. After the workpiece has been frozen and become brittle, start up the motor 13 to rotate the magnetic disc 14, forcing the magnetically conductive grinding media 17 to impact the workpiece and to further remove burrs from the workpiece and polish the workpiece.

Figure 2:
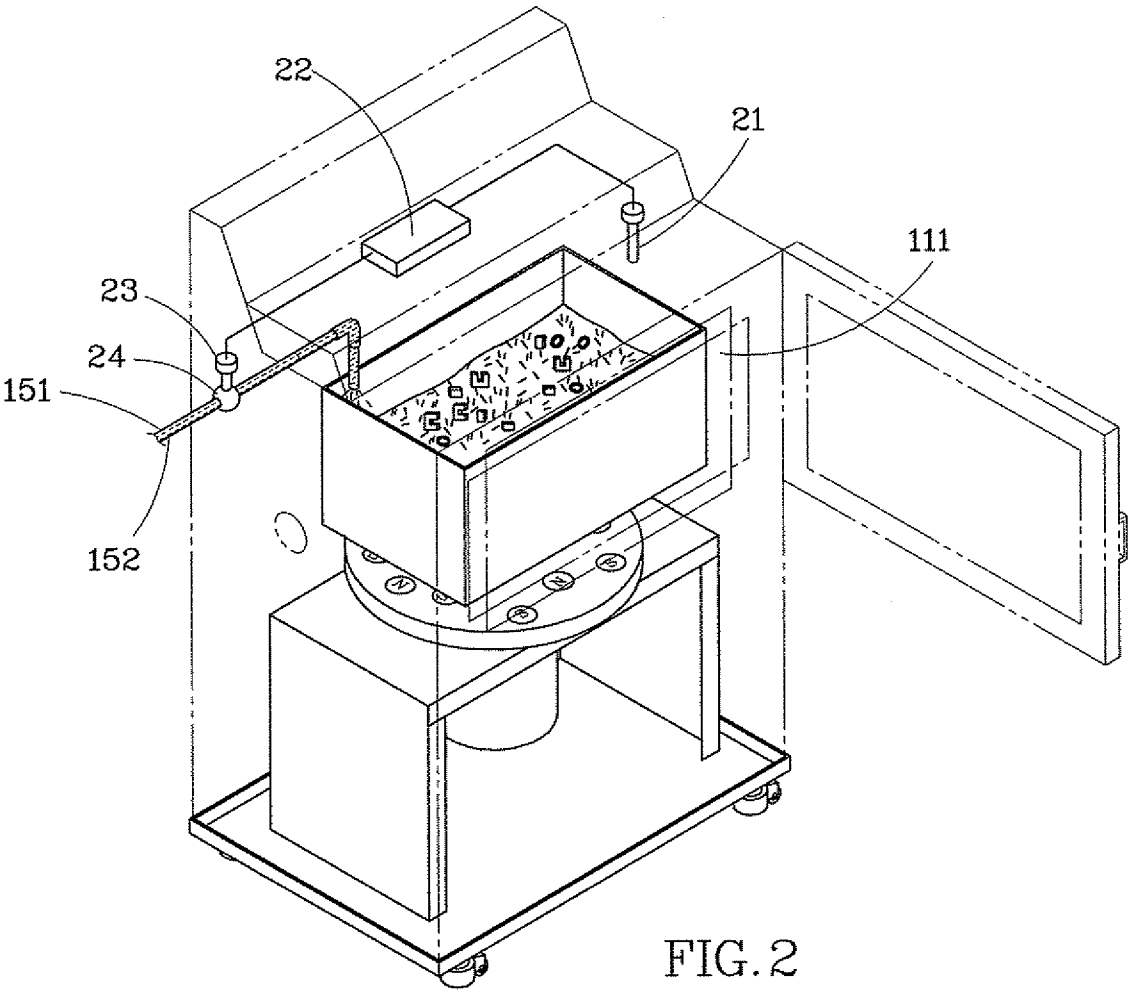
FIG. 2 is a perspective view of an ultra-low temperature magnetic polishing machine in accordance with a second embodiment of the present invention.

FIG. 2 illustrates an ultra-low temperature magnetic polishing machine in accordance with a second embodiment of the present invention. Because temperature control has a great concern with the change of the mechanical properties of the workpiece, it is necessary to accurately control the temperature in the grinding chamber. This second embodiment is substantially similar to the aforesaid first embodiment with the exception that the ultra-low temperature magnetic polishing machine of this second embodiment further comprises a temperature sensor 21 installed in the grinding chamber 111 for sensing the temperature in the grinding chamber 111, a temperature controller 22 electrically connected with the temperature sensor 21 and adapted for receiving the signal produced by the temperature sensor 21, and electromagnetic valve 23 electrically connected with the temperature controller 22 and mounted in the output pipeline 151 and controllable by the temperature controller 22 to close or open the output pipeline 151. When the electromagnetic valve 23 is opened, the freezing medium 152 can be delivered through the output pipeline 151 into the grinding chamber 111. When the electromagnetic valve 23 is closed, the freezing medium 152 is stopped and cannot be delivered through the output pipeline 151 into the grinding chamber 111.

For controlling the temperature inside the grinding chamber 111 precisely, a flow rate control valve 24 shall be used. The flow rate control valve 24 is mounted in the output pipeline 151 and connected with the temperature controller 22. Thus, the flow rate control valve 24 can be controlled by the temperature controller 22 to control the flow rate of the freezing medium 152 passing through the output pipeline 151.

The operation of this second embodiment is same as the aforesaid first embodiment. Therefore, no further detailed description in this regard is necessary.

Figure 3:
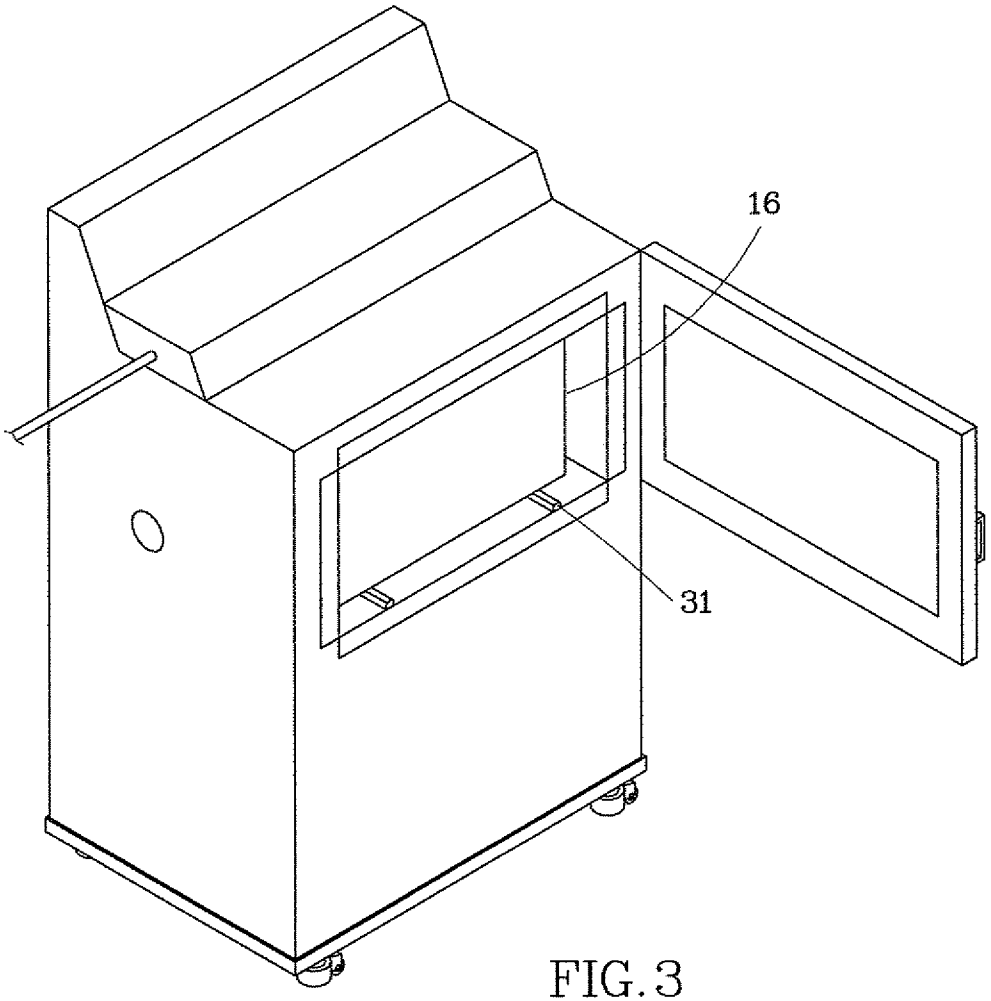
FIG. 3 is an elevational view of an ultra-low temperature magnetic polishing machine in accordance with a third embodiment of the present invention, illustrating a sliding track fixedly provided in the grinding chamber of the housing.

FIG. 3 illustrates an ultra-low temperature magnetic polishing machine in accordance with a third embodiment of the present invention. To provide the user with a convenient operation environment, a sliding track 31 is fixedly provided in the grinding chamber 111 of the housing 11 so that the container 16 can be moved in and out of the grinding chamber 111 along the sliding track 31.

Figure 4:
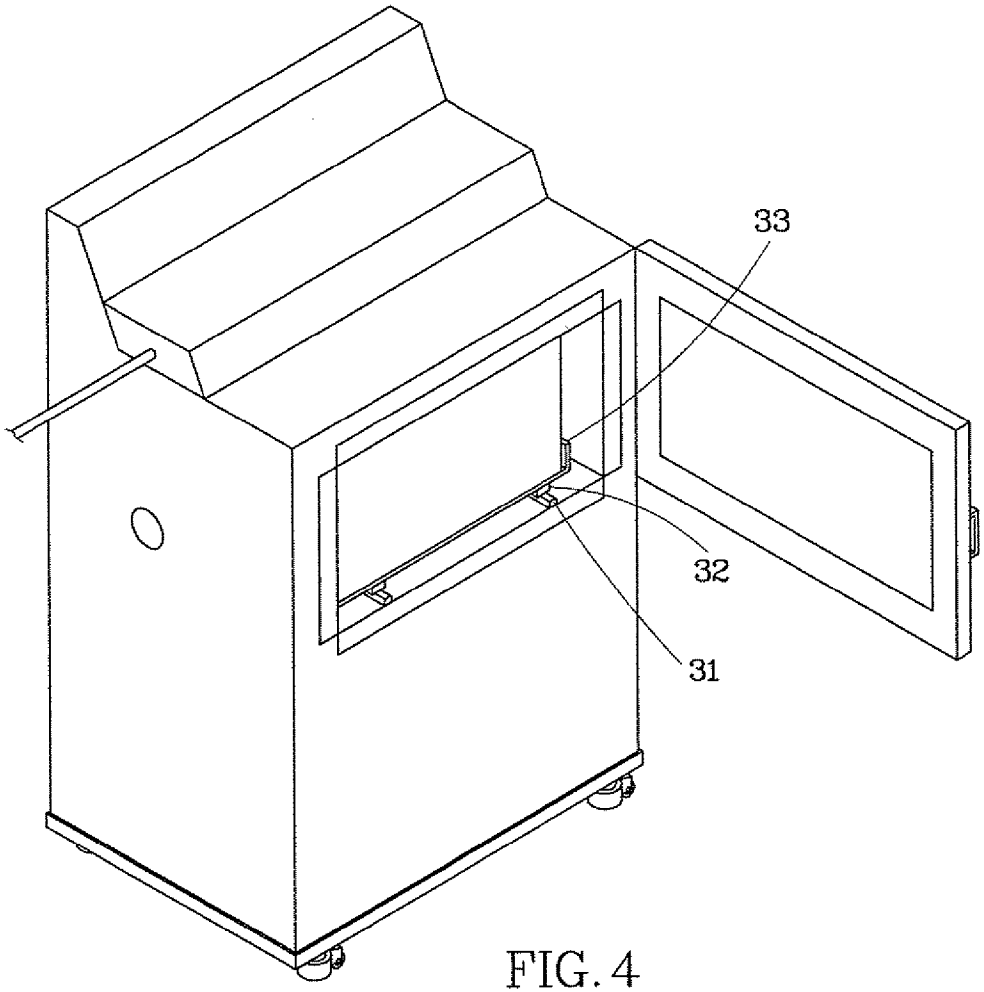
FIG. 4 corresponds to FIG. 3, illustrating a sliding block coupled to the sliding track and a carrier board mounted on the sliding block.

Further, as shown in FIG. 4, a sliding block 32 is coupled to and movable along the sliding track 31, and a carrier board 33 is affixed to the sliding block 32 for carrying the container 16.

Figure 5:
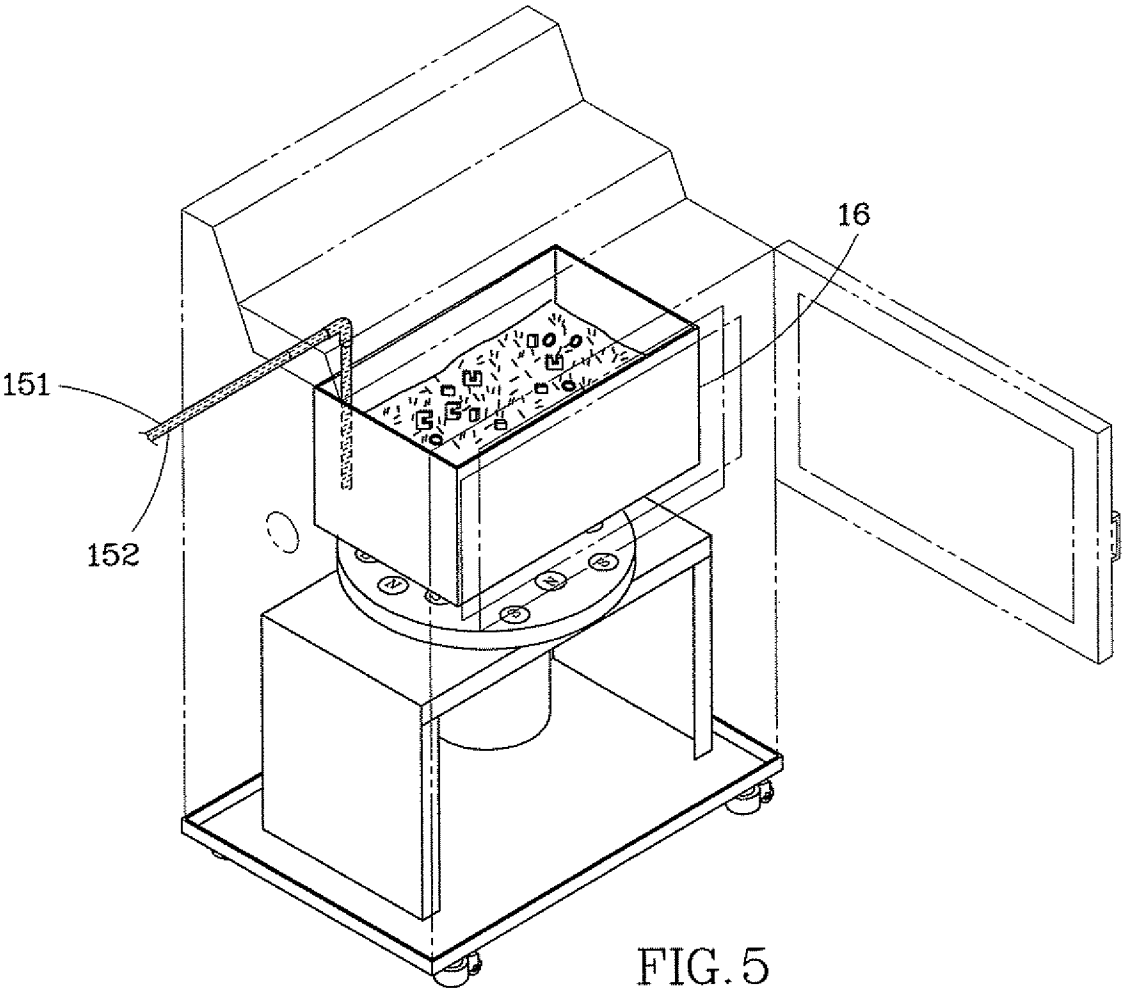
FIG. 5 is a perspective view of an ultra-low temperature magnetic polishing machine in accordance with a fourth embodiment of the present invention.
Figure 6:
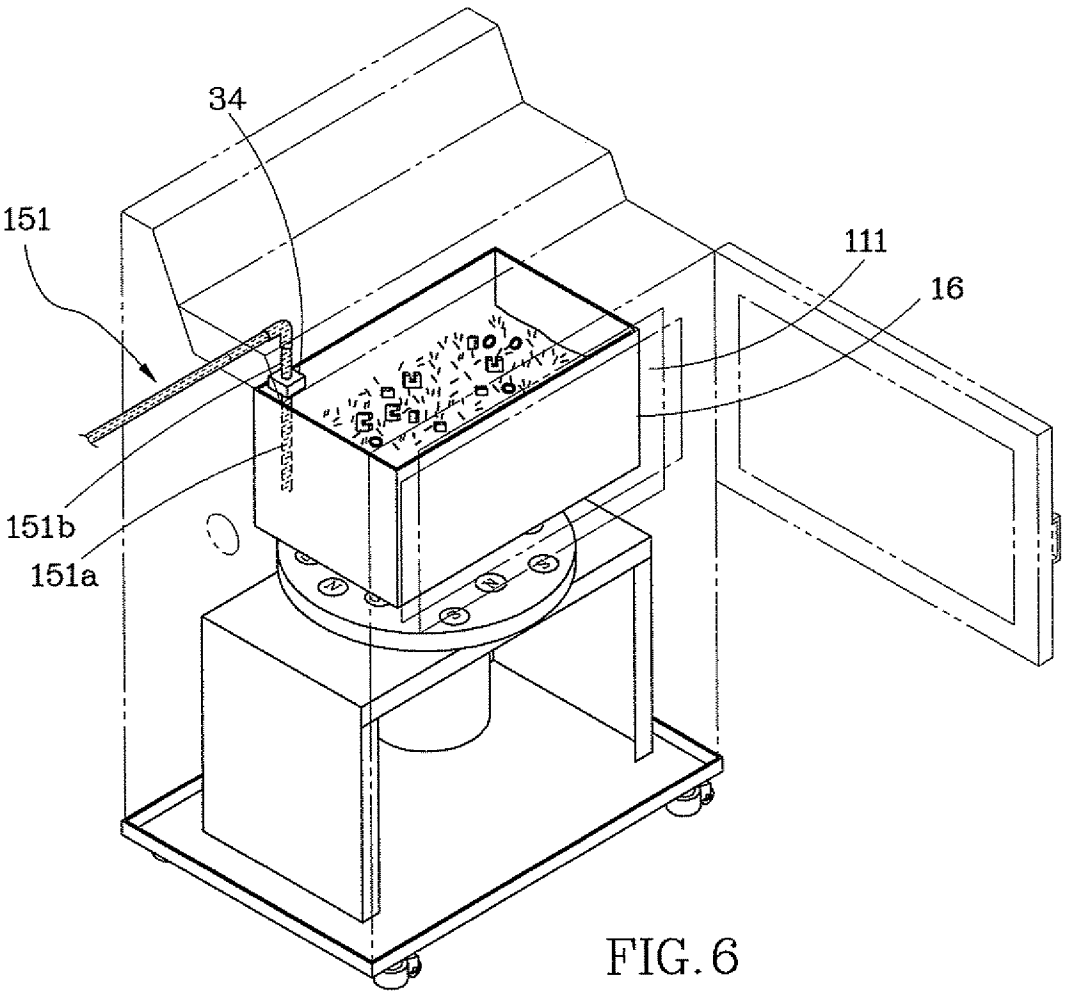
FIG. 6 corresponding to FIG. 5, illustrating a quick release connected between the first output segment and second output segment of the output pipeline.

FIGS. 5 and 6 illustrate an ultra-low temperature magnetic polishing machine in accordance with a fourth embodiment of the present invention. According to this fourth embodiment, the output pipeline 151 extends to the inside of the grinding chamber 111 and is inserted into the container 16 for delivering the freezing medium 152 directly into the container 16 to freeze the workpiece rapidly. Further, the output pipeline 151 can be made having a first output segment 151*b*, a second output segment 151*a*, and a quick release 34 that connects the first output segment 151*b* and the second output segment 151*a*. The first output segment 151*b* is inserted into the grinding chamber 111. The second output segment 151*a* is inserted into the container 16. The second output segment 151*a* can be affixed to the container 16, and movable with the container 16 in and out of the grinding chamber 111. After the container 16 is put in the grinding chamber 111, use the quick release 34 to connect the second output segment 151*a* to the first output segment 151*b*.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An ultra-low temperature magnetic polishing machine, comprising:

a housing defining therein a grinding chamber;

a door hinged to said housing and controllable to open/close said grinding chamber;

a motor mounted inside said housing below said grinding chamber;

a magnetic disc set in between said grinding chamber and said motor and rotatable by said motor, said magnetic disc having an N pole and a S pole for causing an alternative magnetic field in said grinding chamber during rotation of said magnetic disc by said motor;

a freezer, said freezer comprising an output pipeline inserted into said grinding chamber, and freezing medium deliverable through said output pipeline into said grinding chamber;

a container set in said grinding chamber; and a plurality of magnetically conductive grinding media put in said container;

further comprising a temperature sensor installed in said grinding chamber, a temperature controller electrically connected with said temperature sensor, and a valve electrically connected with said temperature controller and mounted in said output pipeline and controllable by said temperature controller to close/open said output pipeline.

2. The ultra-low temperature magnetic polishing machine as claimed in claim 1, further comprising a thermal insulation material mounted in said housing around said grinding chamber to prohibit temperature transfer between said grinding chamber and the outside space.

3. The ultra-low temperature magnetic polishing machine as claimed in claim 1, wherein said freezing medium is selected from the group of liquid nitrogen and liquid carbon dioxide.

4. The ultra-low temperature magnetic polishing machine as claimed in claim 2, wherein said housing has an exhaust port located on one lateral sidewall thereof in communication with said grinding chamber.

5. The ultra-low temperature magnetic polishing machine as claimed in claim 1, wherein said valve is a flow rate control valve controllable to said temperature controller to control the flow rate of said freezing medium passing through said output pipeline.

6. The ultra-low temperature magnetic polishing machine as claimed in claim 1, wherein said housing comprises a sliding track mounted in said grinding chamber and adapted for guiding said container in and out of said grinding chamber.

7. The ultra-low temperature magnetic polishing machine as claimed in claim 6, wherein said housing further comprises a sliding block coupled to and movable along said sliding track, and a carrier board fixedly mounted on said sliding block and adapted for carrying said container.

8. The ultra-low temperature magnetic polishing machine as claimed in claim 1, wherein said output pipeline has an output end thereof extending into said grinding chamber and inserted into said container.

9. The ultra-low temperature magnetic polishing machine as claimed in claim 8, wherein said output end of said output pipeline comprises a first output segment suspending in said grinding chamber, a second output segment extending to the inside of said container, and a quick release adapted for connecting said second output segment to said first output segment.

* * * * *